United States Patent [19]

Caruana

[11] Patent Number: 4,597,528

[45] Date of Patent: Jul. 1, 1986

[54] LAWN SPRINKLER

[75] Inventor: Joseph Caruana, Clwyd, Wales

[73] Assignee: Hozelock-ASL Limited, Aylesbury, England

[21] Appl. No.: 659,422

[22] Filed: Oct. 10, 1984

[30] Foreign Application Priority Data

Oct. 13, 1983 [GB] United Kingdom ..... 8327423
Nov. 21, 1983 [GB] United Kingdom ..... 8331049

[51] Int. Cl.[4] ..... B05B 3/04; B05B 3/08; B05B 3/16

[52] U.S. Cl. ..... 239/381; 239/222.17; 239/231

[58] Field of Search ..... 239/222.11, 222.17, 239/222.21, 231, 380, 381, DIG. 1

[56] References Cited

U.S. PATENT DOCUMENTS 1,467,601 9/1921 Chambers ..... 239/222.17
1,481,327 11/1922 Merseles ..... 239/222.17 X
2,634,163 4/1953 Double ..... 239/DIG. 1

*Primary Examiner*—Joseph F. Peters, Jr.
*Assistant Examiner*—Patrick N. Burkhart
*Attorney, Agent, or Firm*—Lee, Smith & Zickert

[57] ABSTRACT

A lawn sprinkler has a base 10 through which water is directed to a nozzle which directs the water vertically upwardly onto a water dispersing member 28 which is rotatably mounted on a vertical spindle 46. The water impinges first upon a convexly curved surface 52 when it is deflected onto a concavely curved surface 54. The reaction to the force of the water on the dispersing member 28 causes the latter to rotate on the spindle 46, so that water droplets are flung off the edge of the concave surface 54 through a range of angles of inclination as the dispersing member rotates to afford 360° coverage around the sprinkler.

5 Claims, 4 Drawing Figures

LAWN SPRINKLER

FIELD OF THE INVENTION

This invention relates to lawn sprinklers.

BACKGROUND TO THE INVENTION

The invention aims to provide a lawn sprinkler which is simple and reliable in operation, has fewer moving parts than known sprinklers and provides good distribution of spray, particularly in the area close to the sprinkler.

SUMMARY OF THE INVENTION

According to the invention there is provided a lawn sprinkler comprising a water dispersing member mounted for free rotation about a vertical axis, and a nozzle which is arranged to direct a water jet upwardly, in a direction parallel to said axis of rotation of the dispersing member, onto a first, convexly curved surface of the dispersing member, the latter surface being arranged to distribute the water from the jet onto a second, concavely curved surface of the dispersing member which is configured and positioned such that the water impinging thereon is dispersed from the concavely curved surface through a substantial range of angles of elevation, the reaction to the force of water impinging on the dispersing member being arranged to cause rotation of the dispersing member about said axis, so that the water flung off the dispersing member is distributed through 360° about said axis of rotation.

Preferably, the dispersing member is shaped so that water is dispersed therefrom through a range of angles of elevation extending from substantially vertically downwardly to substantially horizontal. Conveniently, the convexly curved surface has a radius of curvature perpendicular to the radius of curvature of the concavely curved surface. In the preferred embodiment to be described the convexly curved surface is part-cylindrical, the corresponding notional cylinder having a substantially horizontal central axis, and the concavely curved surface is also part-cyclindrical, the corresponding notional cylinder having a substantially horizontal central axis orthogonal to the central axis of the cylinder forming part of the convexly curved surface. The convexly curved surface and the concavely curved surface may be adjacent on the water dispersing member and may adjoin along a line of transition.

The dispersing member is preferably pivotally mounted on a spindle which extends upwardly through said nozzle, with an annular clearance between the spindle and the nozzle for the passage of water.

A lawn sprinkler forming a preferred embodiment of the invention will now be described, by way of example, with reference to the accompanying drawings, in which.

DETAILED DESCRIPTION OF THE DRAWINGS

Figure 1:
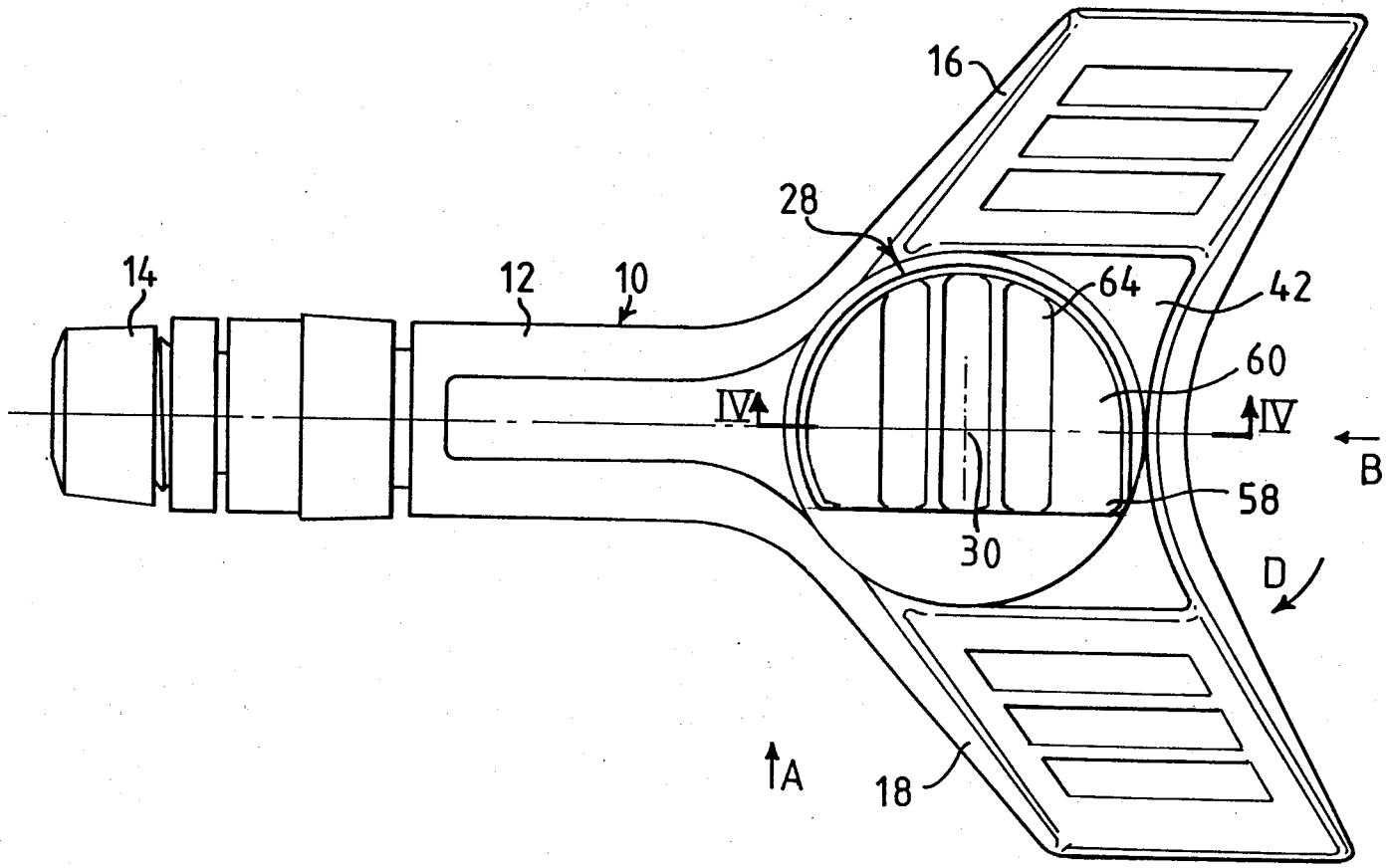
FIG. 1 is a plan view of the lawn sprinkler.
Figure 2:
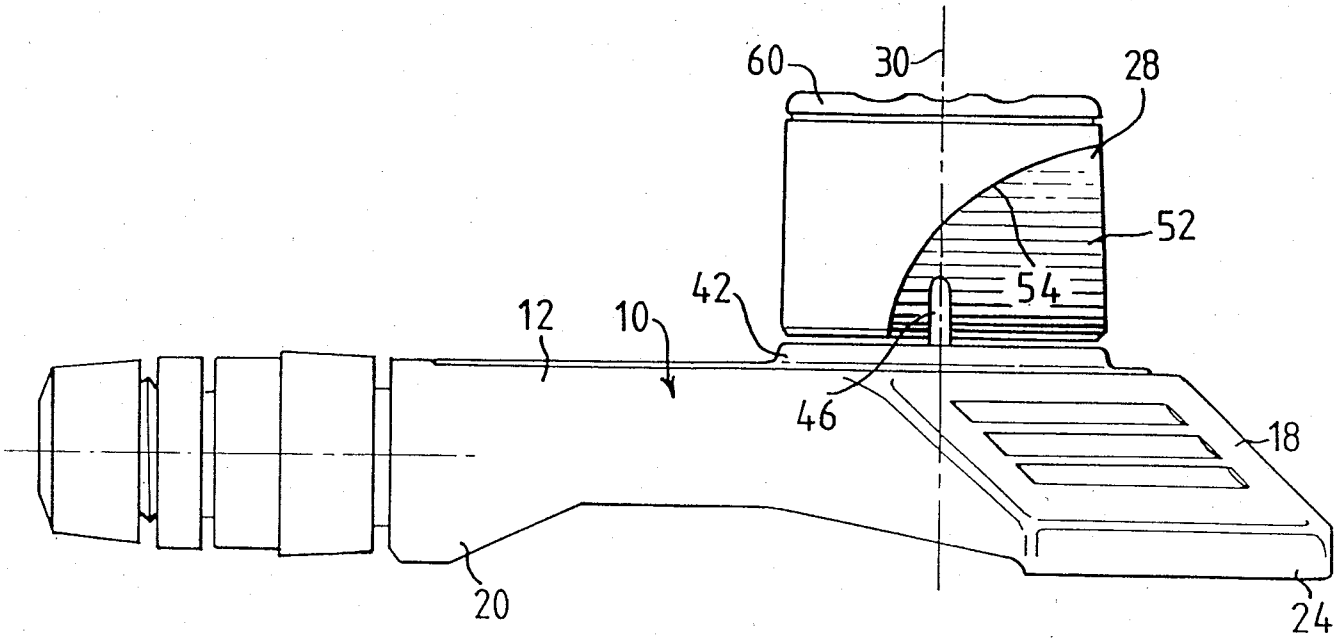
FIG. 2 is a side view of the sprinkler, looking in the direction of arrow A in FIG. 1.
Figure 3:
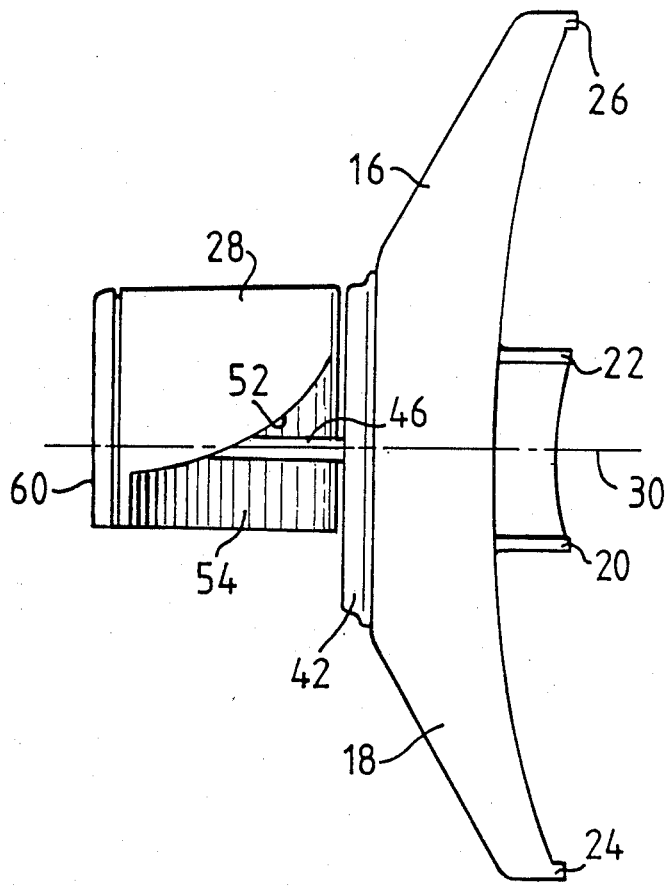
FIG. 3 is an end view of the sprinkler, looking in the direction of arrow B in FIG. 1.

The lawn sprinkler has a base 10 which is generally Y-shaped in plan, as viewed in FIG. 1. To one limb 12 of the base 10 is attached a hose connector 14, providing for attachment to a flexible hose (not shown). The two remaining limbs 16, 18 of the base 10 extend outwardly in a splayed manner to afford stability of the sprinkler which rests on the ground at four locations 20, 22, 24, 26 disposed on the undersides of the limbs 12, 16, 18, as shown in FIGS. 2 and 3.

Figure 4:
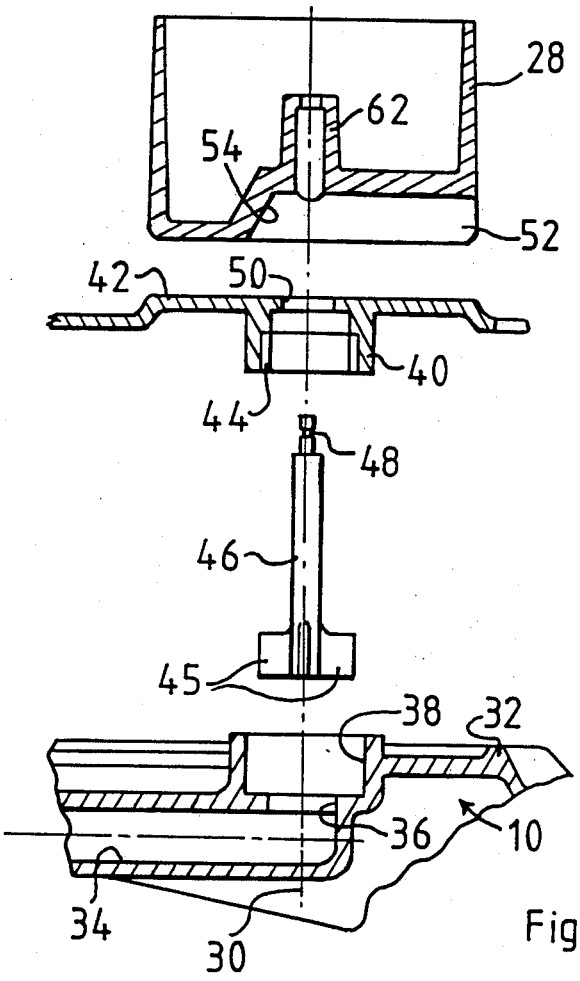
FIG. 4 is a fragmentary exploded view of parts of the sprinkler, shown in section on the line IV—IV in FIG. 1.

At the region where the limbs 12, 16, 18 meet, a water dispersing member 28 is mounted on the base 10 about a vertical pivot axis 30. Referring to FIG. 4, it can be seen that the base 10 has a moulded body 32 having a water passage 34 which leads from the hose connector 14, through the core of the limb 12 to a circular aperture 36 centred on the axis 30. The aperture 36 leads to a circular recess 38 into which fits a boss-like projection 40 formed on the underside of a cover 42, visible also in FIGS. 1 to 3. The internal wall of the boss-like projection 40 has four equi-angularly disposed slots 44, and the slots receive four fins 45 formed on a spindle 46. The spindle extends upwardly, with all round radial clearance with respect to a circular aperature 50 in the cover 42, and the water dispersing member 28 is pivotally mounted on the projecting upper end of the spindle 46 which is retained in position and held against rotation by the location of the fins 45 in the slots 44.

The water dispersing member 28 has a convexly part-cylindrical surface 52 adjoining a concavely curved part-cylindrical surface 54. The position of the surface 52 is best shown in FIG. 3, and the position of the surface 54 is best shown in FIG. 2. The two surfaces 52 and 54 have radii lying in orthogonal planes and meet along a complexly curved line. It can be seen from FIG. 1 that the water dispersing member 28 has a part-cylindrical outer wall and a recess bounded by the surfaces 52 and 54 and also has a projection 58 (best seen in FIG. 1) overlying the upper region of the concave surface 54. The water dispersing member 28 is moulded from a plastics material so as to be hollow, the member 28 being covered by a separately moulded cap 60 secured (eg by sonic welding) on the top of the member 28.

The member 28 is moulded with a cylindrical bearing sleeve 62 (FIG. 4) by which the member 28 is pivotally mounted on the spindle 46. A circlip or the like (not shown locates in a groove 48 at the upper end of the spindle 46 to prevent the member 28 being lifted off the spindle which is fixed in the base 10 by virtue of the cover 42 being sonically welded to the moulded body 32.

In use, water supplied by the hose pipe passes through the hose connector 14 and water passage 34 to reach the chamber defined within the boss-like projection 40. From this chamber, the water issues as a jet from the nozzle defined by the annular clearance gap between the aperture 50 and the spindle 46. The upwardly directed stream of water issuing from the nozzle impinges upon the convex surface 52, whence it is deflected onto the concave surface 54. The result is that the water streams off the outer edge of the concave surface, water droplets of comparatively low velocity leaving the lower part of the edge and the water droplets of higher velocity leaving the higher part of the edge.

Each of the curved surfaces 52 and 54 extends through an arc of approximately 90°, and water leaves the edge of the concave surface through a range of angles of elevation between vertically downwards (at the lower part of the edge) and horizontal (at the upper part of the edge).

The reaction to the force of the water impinging on the dispersing member 28 causes the member 28 to rotate about the spindle 46 in the direction of the arrow D in FIG. 1. The result is that a substantially continuous circular area is sprayed, the non-sprayed area in the immediate vicinity of the sprinkler being very small, and in any event, very much smaller than in many conventional sprinklers.

The dispersing member 28 is shaped so as to be dynamically balanced and prevent vibration. To achieve this, the dispersing member 28 has a weighted or solid portion the position of which is indicated at 64 in FIG. 1.

I claim:

1. A lawn sprinkler comprising a base and a water dispersing member mounted for free rotation about a vertical axis, the water dispensing member having a first convexly curved part-cylindrical surface with a center of curvature formed by a first horizontal axis, and a second concavely curved part-cylindrical surface with a center of curvature formed by a second horizontal axis orthogonal to the first horizontal axis, the base having a nozzle which is arranged to direct a water jet upwardly, in a direction parallel to said axis of rotation of the dispersing member, onto the first, convexly curved surface of the dispersing member, the latter surface being arranged to distribute the water from the jet onto the second concavely curved surface of the dispersing member which is configured and positioned such that the water impinging thereon is dispersed from the concavely curved surface through a substantial range of angles of elevation, the reaction to the force of water impinging on the dispersing member being arranged to cause rotation of the dispersing member about said axis, so that the water flung off the dispersing member is distributed through 360° about said axis of rotation.

2. A lawn sprinkler according to claim 1, wherein the dispersing member is shaped so that water is dispersed therefrom through a range of angles of elevation extending from vertically downwardly to substantially horizontal.

3. A lawn sprinkler according to claim 1, wherein the convexly curved surface and the concavely curved surface are adjacent on the water dispersing member and adjoin along a line of transition between the two curved surfaces, the convexly curved surface and the concavely curved surface forming the walls of a recess in the water dispersing member.

4. A lawn sprinkler according to claim 1, wherein the dispersing member is pivotally mounted on a spindle which extends upwardly through said nozzle, with an annular clearance between the spindle and the nozzle for the passage of water.

5. A lawn sprinkler according to claim 4, wherein the spindle extends through an aperture in the convexly curved surface.

* * * * *